United States Patent [19]

Richert et al.

[11] 4,444,413

[45] Apr. 24, 1984

[54] HEELHOLDER FOR SAFETY SKI BINDINGS

[75] Inventors: Manfred Richert, Farchant; Roland Jungkind, Garmisch-Partenkirchen, both of Fed. Rep. of Germany

[73] Assignee: Marker-Patentverwertungsgesellschaft mbH., Baar, Switzerland

[21] Appl. No.: 298,154

[22] Filed: Aug. 31, 1981

[30] Foreign Application Priority Data

Sep. 2, 1980 [DE] Fed. Rep. of Germany ..... 3033021

[51] Int. Cl.[3] ..... A63C 9/084

[52] U.S. Cl. ..... 280/632; 280/633; 280/634

[58] Field of Search.....280/631, 632 OR, 633x, 280/616, 628, 634

[56] References Cited

U.S. PATENT DOCUMENTS

| | | | |
|---|---|---|---|
| 3,606,369 | 9/1971 | Batal | 280/634 |
| 3,909,023 | 9/1975 | Zoor | 280/631 |
| 4,103,930 | 8/1978 | Valoh | 280/631 |
| 4,111,453 | 9/1978 | Krob | 280/626 |
| 4,214,773 | 7/1980 | Wittmann | 280/631 |

FOREIGN PATENT DOCUMENTS

| | | | |
|---|---|---|---|
| 296839 | 2/1972 | Austria . | |
| 302124 | 10/1972 | Austria . | |
| 341393 | 2/1978 | Austria . | |
| 1578872 | 2/1966 | Fed. Rep. of Germany . | |
| 2340420 | 2/1975 | Fed. Rep. of Germany | 280/628 |
| 2432646 | 1/1976 | Fed. Rep. of Germany | 280/631 |
| 2450163 | 5/1976 | Fed. Rep. of Germany | 280/631 |
| 2535534 | 2/1977 | Fed. Rep. of Germany . | |

*Primary Examiner*—David M. Mitchell
*Assistant Examiner*—Joseph McCarthy
*Attorney, Agent, or Firm*—D. Peter Hochberg

[57] ABSTRACT

A heelholder for a safety ski binding having a baseplate, a slide mounted for movement between forward and rearward positions, a soleholder pivotally mounted on the slide for movement between closed and open position, a locking device mounted on the soleholder for movement between an obstructed position where it holds the soleholder in the closed position and an unobstructed position, a locking lever for releasably obstructing the locking device against movement from the obstructed position, and a blocking lever mounted on the slide for movement between a blocking condition wherein the blocking lever holds the locking device in the obstructed position and an unblocking condition wherein the blocking lever moves the locking device out of the obstructed position.

10 Claims, 6 Drawing Figures

HEELHOLDER FOR SAFETY SKI BINDINGS

This invention relates to a heelholder for a safety ski binding, which heelholder comprises a baseplate adapted to be secured to the top of the ski, a slide, which is similar to a housing and longitudinally slidably mounted on said baseplate and in the open position of the heelholder (when no skiing boot has been inserted into the binding) is held in its forward end position under the action of a contact pressure spring, a soleholder that is pivoted to said slide on a horizontal transverse axis and biased by an opening spring and carries a closing pedal, a locking lever, which is pivoted to said housing on an axis that is parallel to said transverse axis, a restraining spring biasing said locking lever, which when the heelholder is in operative position (when the skiing boot has been inserted) interengages with a part carried by the soleholder and optionally a handle for arbitrarily opening the heelholder.

Various embodiments of such heelholders are known. All of them have the disadvantage that when the skiing boot is released by the toe iron the soleholder will not automatically move to its open position. As a result, after a release caused by a twisting fall, which occurs much more frequently than a release after a frontal fall, the heelholder must be moved to its open position by a separate manipulation before the boot can be re-inserted into the binding.

German Early Disclosure No. 25 35 534 discloses for a safety ski binding a heelholder which is free from the above-mentioned disadvantage and opens automatically whenever the skiing boot has been released by the safety binding. But the design proposed to that end is so poor that that heelholder has not been accepted in practice, although it constitutes an improvement over the other known heelholders in principle.

The slide and the soleholder are combined in a functional unit, which is pivotally movable relative to the baseplate and capable of a parallel displacement relative thereto. The locking lever is mounted on the baseplate and serves also as a handle for arbitrarily opening the heelholder. Constant release values cannot be obtained with such bindings owing to the strong influences which are due to friction. Besides, it is not possible to close the binding when there is snow under the sole.

It is an object of the present invention so to improve designs which have proved well in practice that the soleholder will automatically move to its open position when the skiing boot is released by the safety ski binding.

In a heelholder of the kind described first hereinbefore, this object is accomplished in accordance with the invention in that said part which is carried by the soleholder and interengageable with the locking lever consists of a lever and in operative position is blocked by blocking means, and a stop is provided, which is secured to the baseplate and adapted to cooperate with the blocking means.

Further features of the heelholder according to the invention will become apparent as the description proceeds.

An embodiment of the invention will now be described by way of example with reference to the accompanying drawings, in which FIG. 1 is a central section view showing the heelholder according to a first embodiment in operative position, when the skiing boot has been inserted;

Figure 1:
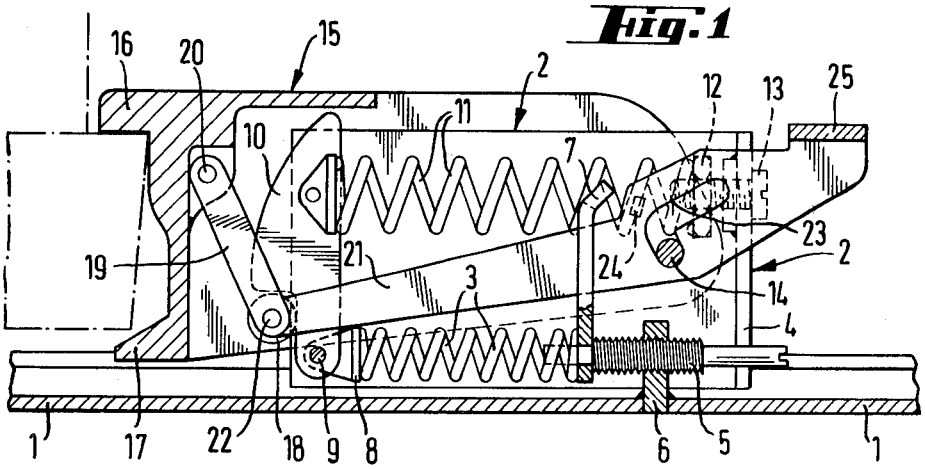
Figure 2:
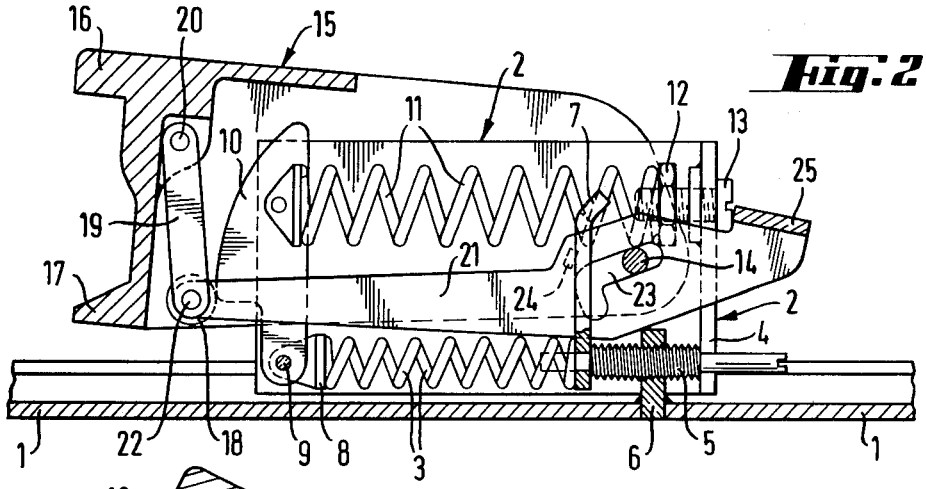
FIG. 2 is a view that is similar to FIG. 1 but shows the heelholder as it is automatically opened in response to a release of the skiing boot by the toe iron, which is not shown.
Figure 3:
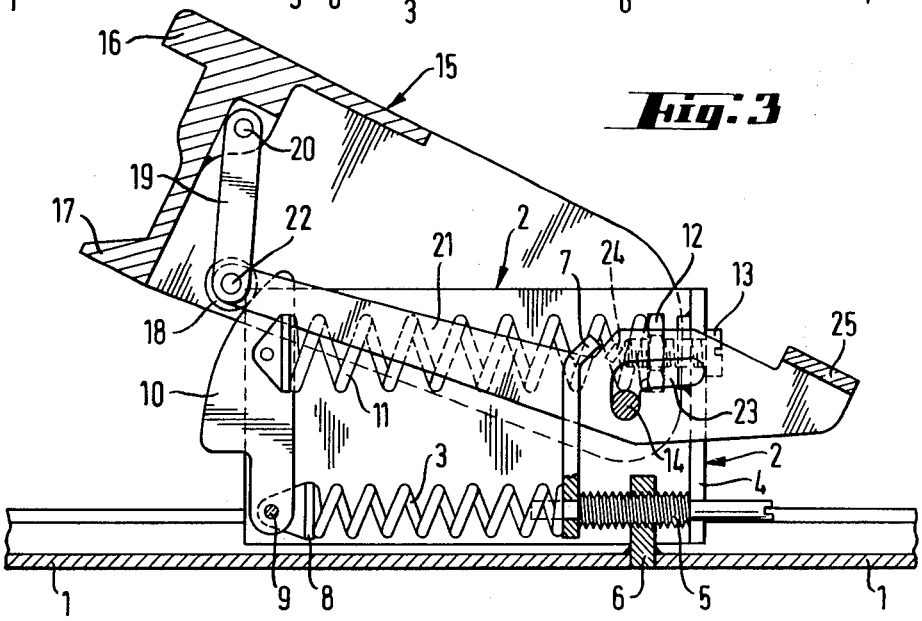
FIG. 3 shows the heelholder of FIGS. 1 and 2 in an open position.

The heelholder shown in FIGS. 1 to 3 comprises a baseplate 1, which is adapted to be secured in conventional manner to the top of a ski, not shown. A slide 2 which is similar to a housing is mounted on the baseplate also in a conventional manner and is slidable in the longitudinal direction. The slide is biased by a contact pressure spring 3, which when the heelholder is in its open position, shown in FIG. 3, holds the slide in its forward end position. That end position is defined by the engagement of the rear end wall 4 of the slide with a collar of an adjusting screw 5. The adjusting screw has screw threads in threaded engagement with a tapped hole of a retaining member 6, which is secured to the baseplate 1. A stop 7 is rotatably and axially immovably mounted on the adjusting screw. The function of that stop will be described hereinafter. The contact pressure spring 3 bears on the adjusting screw 5 through the intermediary of said stop.

The contact pressure spring acts through the intermediary of a pressure-appyling member 8 on a crosspin 9, which is held in the side walls of the slide 2. A locking lever 10 is mounted on said crosspin and is biased by a restraining spring 11, which bears on the rear end wall 4 of the slide 2 through the intermediary of a nut 12 and an adjusting screw 13.

A pivot pin 14 which is parallel to the crosspin 9 is secured in the side walls of the slide 2. A soleholder generally designated 15 is mounted on the pivot pin 14 and is biased by an opening spring, which is conventional and for this reason is not shown. When no skiing boot has been inserted into the binding, the opening spring holds the soleholder in the open position shown in FIG. 3. The soleholder 15 comprises a holding-down member 16 and a pedal spur 17.

In accordance with the present invention a detent roller 18 is provided to cooperate with the locking lever 10 and is mounted on a lever 19. The latter is pivoted to the soleholder 15 on a horizontal crosspin 20. A blocking rod 21 is provided to block the lever 19 when the heelholder is in operative position, shown in FIG. 1. The blocking rod 21 is connected to the lever 19 by means of the axle 22 of the detent roller 18. The blocking rod is formed with a cam slot 23 for guiding the rod on the pivot pin 14 for the soleholder 15. The cam slot is angled to comprise a first portion, which is at least approximately tangential with respect to its point of contact with the lever 19 and is adjoined by a second portion, which is approximately radial. A nose 24 formed on the blocking rod serves to cooperate with the stop 7. That end portion 25 of the blocking rod which is on the right in the drawing extends out of the slide 2 and constitutes a handle for arbitrarily opening the heelholder when the skiing boot has been inserted. By the above-mentioned opening spring, not shown, the blocking rod is biased so that the pivot pin 14 extends normally through the tangential portion of the cam slot 23.

The heelholder operates as follows:

The skiing boot is stepped into the binding in the known manner so that the heelholder moves from the position of FIG. 3 to the position of FIG. 1. A comparison of the two Figures shows that in one position the slide 2 has been displaced to the right in the drawing against the force of the contact pressure spring 3 and that in the other position the blocking lever 10 engages the detent roller 18 from behind.

If the holding-down member 16 of the soleholder 15 is subjected to an upwardly directed force which exceeds the opposing force of the restraining spring 11, the locking lever 10 will be turned back in the conventional manner so that a safety release is effected by the heelholder, which then assumes the position shown in FIG. 3.

The heelholder can be opened arbitrarily in that the handle constituted by the end portion 25 of the blocking rod 21 is depressed and is then longitudinally displaced on the pivot pin 14 so that the detent roller 18 disengages the locking lever 10. The latter is held in its forward end position in conventional manner by a stop, not shown. As the skiing boot is then released, the opening spring causes the soleholder 15 to assume its open position, shown in FIG. 3. As the handle is released, the opening spring causes the blocking rod to assume its blocking position on the pivot pin 14.

When the skiing boot has been released by the toe iron, not shown, the slide 2 and the soleholder 15 move to the left from the position shown in FIG. 1. Before the rear end wall 4 of the slide engages the collar on the adjusting screw 5, the nose 24 of the blocking rod 21 engages the stop 7 so that the blocking rod is turned about the axle 22 and is disengaged from the pivot pin 14. The position at the time when the slide strikes on the adjusting screw 5 is shown in FIG. 2. As the lever 19 is no longer blocked, the opening spring causes the soleholder 15 to continue its pivotal movement to the position shown in FIG. 3.

Figure 4:
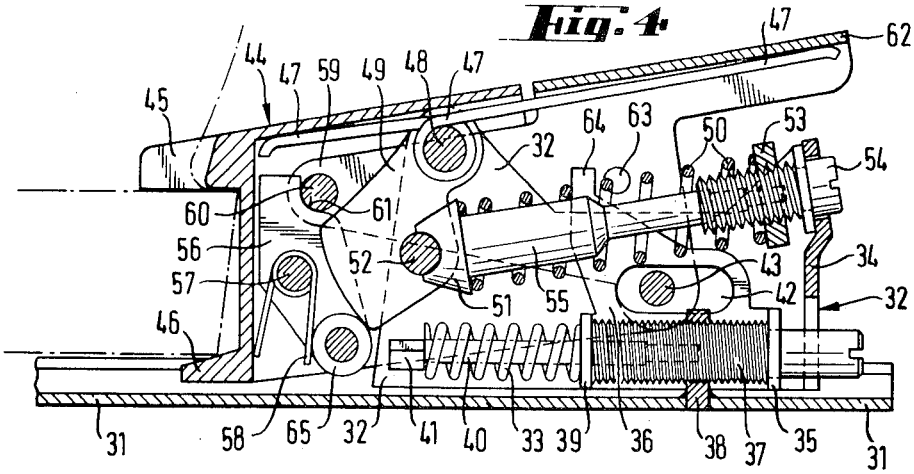
FIGS. 4 to 6 show a heelholder according to a second embodiment in view similar to FIGS. 1 to 3.
Figure 5:
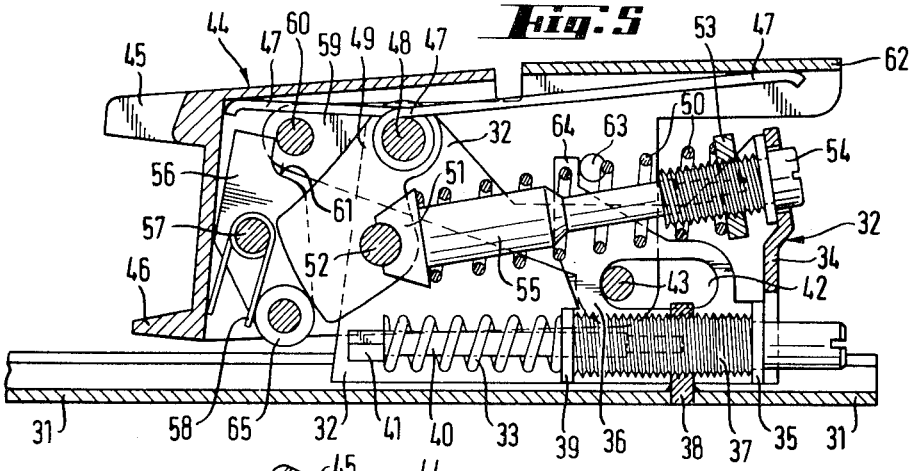
Figure 6:
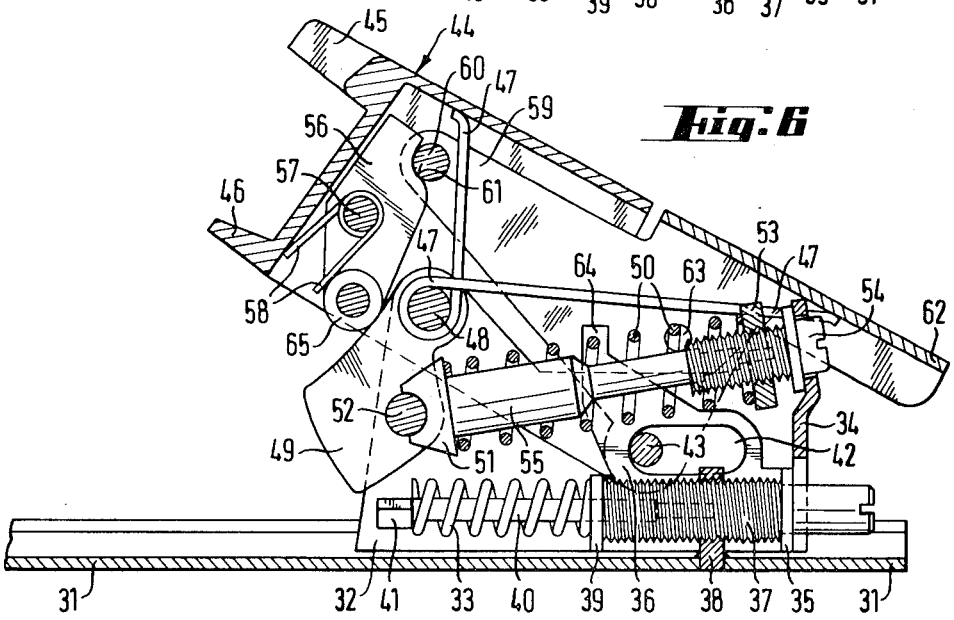

Just as the heelholder just described, the heelholder shown in FIGS. 4 to 6 comprises a baseplate 31, which is adapted to be secured to the top of a ski. A slide 32 which is similar to a housing is mounted on the baseplate and longitudinally slidable and is biased by a contact pressure spring 33. In the open position shown in FIG. 6 the contact pressure spring holds the heelholder in its forward end position, in which the rear end wall 34 of the slide engages one arm 35 of a shaped member 36. That arm 35 engages a collar of the adjusting screw 37, which has an offset portion that extends through a bore in the arm 35. The screw threads of the adjusting screw 37 are in threaded engagement with a tapped hole of a retaining member 38, which is secured to the baseplate 31. A second arm 39 of the shaped member 36 is parallel to the first arm and engages the inner end face of the adjusting screw 37 and constitutes an abutment for the contact pressure spring 33. The contact pressure spring 33 is held on a rod 40, which extends from a crosspiece 41 of the slide 32. The contact pressure spring 33 bears on said crosspiece. The rod 40 extends through the arm 39 and is telescopically received by a mating hole in the adjusting screw 37.

The crosspiece of the shaped member 36 has a slot 42, through which a pivot pin 43 extends, which is secured in the side walls of the slide 32. A soleholder 44 is mounted on the pivot pin 43 and again comprises a conventional holding-down member 45 and a pedal spur 46. The soleholder is biased by an opening spring 47, which consists of a spiral spring and is mounted on a crosspin 48. The latter is held in the side walls of the slide 32 and is parallel to the pivot pin 43. A locking lever 49 is mounted on the crosspin 48 and is biased by a restraining spring 50, which acts on a cross-pin 52 of the locking lever through the intermediary of a spring abutment 51. The restraining spring bears on the rear end wall 34 of the slide 32 through the intermediary of a nut 53 and an adjusting screw 54. The spring abutment 51 is integral with a rod 55, which serves to guide the restraining spring and has a free end portion, which is telescopically received by an axial bore of the adjusting screw 54.

As in the first embodiment, the locking lever 49 cooperates with a detent roller 65, which is mounted on a lever 56, which is mounted on a horizontal crosspin 57 secured to the soleholder 44. The lever is double-armed and biased by a spiral spring 58, which is fitted on the crosspin 57 and urges the detent roller 55 toward the locking lever 49.

A blocking lever 59 is provided to block the lever 56 in that operative position of the heelholder, shown in FIG. 6, and in its open position, shown in FIG. 6. The blocking lever 59 is mounted in the slide 32 on the pivot pin 43, i.e. on the same axis as the soleholder 44. The blocking lever is approximately T-shaped and its pivotal axis is disposed at the free end of its leg. A blocking pin 60 is carried by the blocking lever 59 at that end of its flange which is on the left in the drawing. The blocking pin is adapted to block the lever 56 by entering a recess 61 of the lever 56 (FIG. 2). That portion of the blocking lever 59 which is on the right in the drawing constitutes a handle 62 for arbitrarily opening the heelholder when the skiing boot has been inserted in the binding. The blocking lever 59 is also biased by the opening spring 47 to the position in which the blocking lever 59 blocks the lever 56. The blocking lever 59 is provided in an approximately central portion with a nose 63, which cooperates with a stop 64, which is constituted by the shaped member 36.

The mode of operation of the heelholder shown in FIGS. 4 to 6 is similar to the mode of operation of the heelholder shown in FIGS. 1 to 3 and for this reason will not be described in detail.

When the skiing boot is stepped into the binding the heelholder moves from the position shown in FIG. 6 to the position shown in FIG. 4. A safety release will be effected if the force of the restraining spring 50 is overcome so that the detent roller 65 is disengaged from the locking lever 49 and the heelholder returns to its open position shown in FIG. 6.

For opening the heelholder arbitrarily, the handle 62 of the blocking lever 59 is depressed so that the latter is turned in the clockwise sense in FIG. 4 and the blocking pin 60 disengages the lever 56. The lever 56 can now turn about the crosspin 57 of the soleholder 44 against the force of the spiral spring 58 when the soleholder 44 tends to assume its open position under the influence of the skiing boot and/or the opening spring 47 and/or the blocking lever 59. When the handle has been released and/or shortly before the soleholder 44 reaches its open position shown in FIG. 6, the blocking pin 60 of the blocking lever 59 re-enters the recess 61 of the lever 56.

When the skiing boot is released by the toe iron, the slide 32 and the soleholder 44 move to the left from the position shown in FIG. 4 so that the nose 63 of the blocking lever 59 engages the fixed stop 64 on the shaped member 36. As a result, the blocking lever is arrested and caused to turn about the pivot pin 43 so that the blocking pin 60 disengages the recess 61 of the lever 56, as is shown in FIG. 5. A stop, not shown, is provided and prevents a continued pivotal movement of the locking lever in a forward direction, to the left in the drawings. From the position shown in FIG. 5 the opening spring 47 urges the soleholder 44 upwardly so that the detent roller 65 biased by the weak spring 58 moves around the end of the locking lever 49 and the heelholder is again in the position shown in FIG. 6 at the end of the movement.

As the heelholders shown and described have a handle for arbitrarily opening them, they can be combined with conventional toe irons in a safety ski binding. Besides, the heelholders according to the invention can be used to advantage with toe irons which can be opened arbitrarily but return to their initial position when the skiing boot has been released. In that case the safety ski binding provided with the heelholder according to the invention is always ready to receive the skiing boot. It will be understood that the handle for arbitrarily opening the heelholder is not required in such a combined binding.

What is claimed is:

1. A heelholder for a safety ski binding, said heelholder comprising:

a baseplate attachable to the top of a ski;

stop means mountable in a fixed position relative to said baseplate;

slide means slidably mounted on said baseplate for movement between a forward position when no boot is in the binding and a rearward position when a boot is in the binding, said slide means being biassed towards the forward position;

a soleholder pivotally mounted on said slide means for rotation between open and closed positions, said soleholder being biassed towards the open position and movable to the closed position upon insertion of a boot into the binding;

locking means mounted on said soleholder and movable between an obstructed position for holding said soleholder in the closed position and an unobstructed position for releasably holding said soleholder from the closed position;

locking lever means pivotally mounted on said slide means and movable between a locking position for obstructing said locking means against movement from the obstructed position and an unlocking position for enabling said locking means to move from the obstructed position, said locking lever means being biassed towards the locking position; and blocking means having a blocking condition for holding said locking means in the obstructed position and an unblocking condition for moving said locking means to the unobstructed position, said blocking means cooperating with said stop means to assume the unblocking condition in response to movement of said slide means towards the forward position.

2. The invention according to claim 1 wherein said blocking means comprises manually actuable means for moving said blocking means from the blocking condition to the unblocking condition.

3. The invention according to claim 1 wherein said heelholder further includes axle means for pivotally connecting said blocking means to said locking means, and wherein said blocking means is rotatably attached to said slide means;

said blocking means sliding with said slide means against said stop means, rotating about said axle means and moving said locking means to the unobstructed position when a boot is removed from said soleholder without driving said soleholder to the open position.

4. The invention according to claim 1 wherein said slide means includes pivot pin means, and said soleholder and said blocking means are rotatably mounted on said pivot pin means, and wherein said blocking means includes a cam slot slidably receiving said pivot pin means; said cam slot having a first portion for engaging said pivot pin means to retain said blocking means in the blocking condition, and a second portion for slidingly receiving said pivot pin means to enable movement of said blocking means to the unblocking position.

5. The invention according to claim 4 wherein said blocking means includes abutment means for engaging said stop means when said blocking means slides with said slide means when a boot is removed from the soleholder without driving the soleholder to the open position, to effect the rotation of said blocking means about said axle means to move said pivot pin means out of said first portion of said cam slot to remove said blocking means from the blocking condition.

6. The invention according to claim 1 wherein said locking lever means comprises a lever having an abutment surface; and said heelholder further comprises an axle means connecting said blocking means and said locking means, and detent means rotatably mounted on said axle means, said abutment surface engaging said detent means to retain said locking means in the obstructed position, and said detent means being movable out of engagement with said abutment surface in response to movement of said blocking means to the unblocking condition.

7. The invention according to claim 6 wherein said slide means includes pin means; and said blocking means includes a cam slot having a first portion for engaging said pin means to retain said blocking means in the blocking condition, and a second portion for slidably receiving said pin means to enable movement of said blocking means out of the blocking condition, and a manually actuable section for manually rotating said blocking means about said axle to move said first cam portion out of engagement with said pivot pin means and for manually sliding said blocking means in a path defined by movement of said second cam portion over said pivot pin means to disengage said detent means from said abutment surface.

8. The invention according to claim 7 wherein said blocking means further includes abutment means for engaging said stop means when said heelholder moves from the closed position toward the open position to effect rotation of said blocking means about said axle to move said pin means out of engagement with said first portion and into said second portion of said cam slot.

9. The invention according to claim 1 wherein said slide means includes pivot pin means and said soleholder and said blocking means are rotatably mounted on said pivot pin means, and wherein said blocking means includes blocking pin means engageable with said locking means when said blocking means is in the blocking condition and abutment means engageable with said stop means when said blocking means slides with slide means when a boot is removed from the soleholder without driving the soleholder to the open position, to effect the rotation of said blocking means about said pivot pin means and to disengage said blocking pin means from said locking means to enable opening of said soleholder.

10. The invention according to claim 1 wherein said slide means includes pivot pin means, and said soleholder and said blocking means are pivotally mounted on said pivot pin means, and wherein said blocking means includes blocking pin means engageable with said locking means when said blocking means is holding said locking means in the obstructed position, said blocking means being manually rotatable about said pivot pin means to disengage said blocking pin means from said locking means to remove said locking means from the obstructed position.

* * * * *